US007741001B2

(12) United States Patent
Kamoto

(10) Patent No.: US 7,741,001 B2
(45) Date of Patent: Jun. 22, 2010

(54) TONER FOR ELECTROSTATIC IMAGE DEVELOPMENT AND PROCESS FOR PREPARING THE SAME

(75) Inventor: Takanori Kamoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/395,133

(22) Filed: Apr. 3, 2006

(65) Prior Publication Data

US 2006/0222992 A1 Oct. 5, 2006

(30) Foreign Application Priority Data

Apr. 4, 2005 (JP) ..... 2005-107818
Apr. 4, 2005 (JP) ..... 2005-107822

(51) Int. Cl.
*G03G 7/00* (2006.01)

(52) U.S. Cl. ..... 430/137.14; 430/120.1; 430/109.4; 430/108.6

(58) Field of Classification Search ..... 430/137.14, 430/120.1, 109.4, 108.6
See application file for complete search history.

(56) References Cited

U.S. PATENT DOCUMENTS

| | | | | |
|---|---|---|---|---|
| 6,444,388 | B1 * | 9/2002 | Nagahama et al. | 430/109.4 |
| 2004/0265718 | A1 * | 12/2004 | Nakamura et al. | 430/108.4 |
| 2005/0142478 | A1 * | 6/2005 | Matsumura et al. | 430/124 |
| 2006/0063087 | A1 * | 3/2006 | Ninomiya et al. | 430/109.4 |

FOREIGN PATENT DOCUMENTS

| | | |
|---|---|---|
| JP | 57-154253 | 9/1982 |
| JP | 59-62870 | 4/1984 |
| JP | 63-186253 | 8/1988 |
| JP | 63-282749 | 11/1988 |
| JP | 63-282758 | 11/1988 |
| JP | 5-66600 | 3/1993 |
| JP | 7-152202 | 6/1995 |
| JP | 7-168395 | 7/1995 |
| JP | 7-168396 | 7/1995 |
| JP | 7-219267 | 8/1995 |
| JP | 8-179555 | 7/1996 |
| JP | 8-179556 | 7/1996 |

(Continued)

OTHER PUBLICATIONS

Diamond, Handbook of Imaging Materials, Marcel Dekker, Inc, NY,NY. 1991. pp. 160-162.*
Patent Abstracts of Japan, Yasunobu et al "Method for Manufacturing Electrophotographic Toner", 2004-326001, Nov. 18, 2004.
Patent Abstracts of Japan, Yuka et al "Developer and Image Forming Method", 2004-287269, Oct. 14, 2004.

(Continued)

*Primary Examiner*—Mark F Huff
*Assistant Examiner*—Peter L Vajda
(74) *Attorney, Agent, or Firm*—Nixon & Vanderhye P.C.

(57) ABSTRACT

A process for preparing a toner for electrostatic image development, the process comprising the steps of:

(S1) mixing an aqueous pigment dispersion and an aqueous resin particle dispersion containing self-dispersible polyester resin particles as a binder resin to prepare a mixture; and (S2) adding a polyvalent metal salt as a flocculant to the mixture while stirring to form aggregates of the pigment bonded to the resin particles, wherein the self-dispersible polyester resin is prepared by reacting a carboxylic acid compound with an alcohol compound inclusive of a polyhydric alcohol, the carboxylic acid compound being one or more of a polycarboxylic acid having three or more carboxyl groups and its anhydride.

17 Claims, 1 Drawing Sheet

FOREIGN PATENT DOCUMENTS

| | | |
|---|---|---|
| JP | 9-230624 | 9/1997 |
| JP | 10-26842 | 1/1998 |
| JP | 10-39545 | 2/1998 |
| JP | 2001-92176 | 4/2001 |
| JP | 2002-131977 | 5/2002 |
| JP | 2004-93586 | 3/2004 |
| JP | 2004-326001 | 11/2004 |
| JP | 2004-354411 | 12/2004 |
| JP | 2005-140855 | 6/2005 |

OTHER PUBLICATIONS

Patent Abstracts of Japan, Shigeru et al "Electrostatic Charge Image Developing Toner, Method for Manufacturing the Same and Image Forming Method", 2005-031222, Feb. 3, 2005.

Patent Abstracts of Japan, Noritaka "Method for Manufacturing Toner", 2004-325510, Nov. 18, 2004.

* cited by examiner

TONER FOR ELECTROSTATIC IMAGE DEVELOPMENT AND PROCESS FOR PREPARING THE SAME

CROSS-REFERENCE TO RELATED APPLICATION

This application is related to Japanese Patent Applications No. 2005-107818 filed on Apr. 4, 2005 and No. 2005-107822 filed on Apr. 4, 2005, on the basis of which priorities are claimed under 35 USC §119, the disclosure of these applications being incorporated by reference in their entirety.

BACKGROUND OF THE INVENTION

1. Field of the Invention

The invention relates to a toner for electrostatic image development to be used for an electrophotographic image formation apparatus and a process for preparing the same Furthermore, the present invention relates to an electrostatic image developer, an image formation method using the developer, and a formed image.

2. Description of the Related Art

Along with the remarkable advancement of recent OA appliances, copying machines, printers, and facsimile apparatuses for carrying out printing by utilizing an electrophotographic method have become popular. An electrophotographic image formation apparatus generally carries out image formation by charging, exposing, developing, transferring, cleaning, and fixing steps.

In the charging step, a surface of a photoconductor is evenly charged in a dark place. In the exposing step, an original image is projected to the charged photoconductor to form an electrostatic latent image on the surface of the photoconductor by removing the electric charge in the portion where light is radiated. In the developing step, a toner image (a visible image) is formed by binding a toner to the electrostatic latent image formed on the surface of the photoconductor. In the transferring step, the toner image formed in the surface of the photoconductor is transferred to a recording medium such as paper and a sheet by bringing the toner image formed in the surface of the photoconductor and the recording medium into contact with each other, causing corona electric discharge from the opposed side to the face of the recording medium contacting the toner image, and applying the electric charge with the opposed polarity to that of the toner to the recording medium. In the fixing step, the toner image is fixed to the recording medium by heating or pressurizing means. In the cleaning step, the toner not transferred to the recording medium and remaining on the surface of the photoconductor is recovered. An electrophotographic image formation apparatus forms a desired image on a recording medium through the above-mentioned steps.

A process for preparing of the toner for electrostatic image development to be used an electrophotographic image formation apparatus may include a dry method and a wet method. A pulverization method can be exemplified as the dry method. The pulverization method is a method of obtaining a toner by melting and kneading a resin, a pigment (a coloring agent) and a wax, and pulverizing and classifying the obtained kneaded product by a pulverizer and has been employed widely in an industrial field. A toner is desired to have a small particle diameter so as to form high quality images, however the pulverization method takes increased quantities of energy and time for pulverization and the process becomes complicated and lowers the yield and thus there has been a problem that the product cost considerably soars.

A suspension polymerization method and an emulsion polymerization method can be exemplified as the wet method. The suspension polymerization method is a method of obtaining a toner by suspension-polymerizing synthetic resin monomers such as vinyl monomers in an aqueous solvent containing a pigment.

On the other hand, the emulsion polymerization method is a method of obtaining a toner by mixing an aqueous dispersion of synthetic resin particles and a dispersion of a pigment dispersed in an organic solvent for forming agglomerated particles of the synthetic resin particles and the pigment and heating and melting the agglomerated particles. As it is described in later, this method uses a surfactant in a resin particle dispersion of starting substance for toner preparation and therefore a surfactant remains in the toner to be produced.

There is a method using phase inversion emulsification as another wet method. The phase transfer emulsification method is a method of obtaining toner particles by dissolving or dispersing self-water dispersible resin and pigment in an organic solvent and adding water while adding and stirring a neutralization agent for neutralizing a dissociation group of the resin and thereby carrying out phase transfer emulsification of the resin solution droplets enclosing the pigment. Also, there is another wet method of obtaining toner particles by dissolving or dispersing a resin in a solvent in which the resin is soluble, granulating the obtained solution or dispersion in a water medium containing an inorganic dispersant, removing the solvent, and drying the formed particles. This process of a toner for electrostatic image development is for producing a toner by dissolving or dispersing materials including a polyester resin and a pigment in a solvent in which the polyester resin is soluble, granulating the obtained solution in an aqueous medium containing an inorganic dispersant, and then removing the solvent.

The above-mentioned preparation of the toner by the wet method leaves the organic solvent, monomers of the resin, and a surfactant in the toner to be obtained. Such components bleed out of the toner at the time of practical used of the toner for development of an electrostatic latent image and cause damages of parts such as a development roller. Further, the chargeability of the toner becomes uneven. Accordingly, a step of removing the organic solvent, the monomers, and the surfactant from the toner is required after the toner is produced. However, the shape and the chargeability of the toner to be obtained tend to become uneven in accordance with slight fluctuation of operation conditions relevant to the pressure, temperature, and time in such a removal step. Therefore, to obtain a toner with a uniform shape, it is required to adjust the operation conditions to be optimum and it is very difficult to accomplish the adjustment. Further, since the organic solvent, the monomers, and the surfactant, which are heavy loads on ambient environments, are used in large quantities, the facilities to treat them are required to lead to the cost up of toner preparation. Further, in form of the toner, monomers remain in this emulsion polymerization method. Therefore, there occurs a new problem that remaining monomers are evaporated and emit malodor when heat and pressure are applied to the toner for fixation or the like.

Further, the toner to be obtained by the above-mentioned conventional wet method is not necessarily excellent all in the toner properties such as the image density and the image quality such as fogging, of the image to be formed on a recording medium by using it as well as the dispersibility of the pigment on the recording medium and the transfer ratio of the toner to the recording medium.

For that, as another conventional wet method, Japanese Patent Laid-Open Application No. 10-39545 (Document No.

1) discloses a toner process neither using any organic solvent nor involving any polymerization reaction at the time of forming toner particles. In the process of a toner composition of the Document No. 1, adding an aqueous pigment dispersion obtained by dispersing a pigment in water by using a sodium sulfonated polyester to an emulsion obtained by dispersing the sodium sulfonated polyester in water, further adding an alkali halide solution, and thereby forming agglomerates.

Further, Japanese Patent Laid-Open Application No. 2002-131977 (Document No. 2) discloses a toner process similarly using a self-dispersible resin containing a hydrophilic ethylenic unsaturated monomer. In the Document No. 2, sodium sulfonate or potassium sulfonate of a styrene derivative is used as the hydrophilic ethylenic unsaturated monomer. The method of the Document No. 2 is a method of producing a toner using the self-dispersible resin containing a hydrophilic group of a sulfonic acid metal salt, which is a polyvalent metal salt, as a flocculant.

Also, as a patent using a self-dispersible polyester is exemplified Japanese Patent Laid-Open Application No. 2004-354411 (Document No. 3) and No. 2005-140855 (Document No. 4). They disclose a process of a toner using a mixture of a vinyl type resin dispersion and a self-dispersible polyester. In those documents, it is disclosed that the self-dispersible polyester is preferably polyester resins containing no trivalent monomer. Also, it is disclosed that an ionic surfactant is used as a flocculant for causing soft flocculation.

A toner for electrostatic image development is desirable to contain no unnecessary components such as an organic solvent or monomers, to be produced easily, and to have excellent toner properties.

With respect to the toner process of the Document No. 1, a toner composition is produced by flocculating a pigment dispersed in water by using a sodium sulfonated polyester and a sodium sulfonated polyester dispersed in water and thus the toner composition process capable of producing a toner composition free from unnecessary components such as an organic solvent and monomers. However, since the dispersibility of the pigment is insufficient if the pigment is dispersed by using only the sodium sulfonate polyester, aggregates of solely the pigment are formed the toner property such as a color reproducibility cannot be satisfied and thus the process is unsuitable for producing a toner composition having excellent toner properties. Further, the toner composition produced by the method becomes unstable in the chargeability depending on the ambient environmental conditions and it has a problem that its use is limited in accordance with the environmental conditions and it is supposed that the problem is attributed to the sulfonic acid group, a hydrophilic group.

Similarly, also in the toner process disclosed in the Document No. 2, although the pigment dispersibility is maintained, the properties of a toner to be produced in relation to the ambient environmental conditions have similar problems because of the above-mentioned same reason since the hydrophilic group is a sulfone metal salt.

Further, with respect to toners respectively disclosed in the Document No. 3 and No. 4, they are produced using the mixture of the self-dispersible polyester and the vinyl type resin dispersion. Though the vinyl type resin dispersion is used as mentioned above, the toners contain a monomer. Also, since soft flocculation is caused by using a surfactant, it is very difficult to control the particle diameter.

SUMMARY OF THE INVENITION

According to an aspect of the present invention, there is provided a process for preparing a toner for electrostatic image development, the process comprising the steps of: (S1) mixing an aqueous pigment dispersion and an aqueous resin particle dispersion containing self-dispersible polyester resin particles as a binder resin to prepare a mixture; and (S2) adding a polyvalent metal salt as a flocculant to the mixture while stirring to form aggregates of the pigment bonded to the resin particles, wherein the self-dispersible polyester resin is prepared by reacting a carboxylic acid compound with an alcohol compound inclusive of a polyhydric alcohol, the carboxylic acid compound being one or more of a polycarboxylic acid having three or more carboxyl groups and its anhydride.

In the process of the invention, the self-dispersible polyester resin contains two or more kinds of self-dispersible polyester resins having different number average molecular weights.

According to another aspect of the invention, provided is a toner for electrostatic image development prepared by the above-mentioned process.

In accordance with another aspect of the invention, an electrostatic image developer containing the above-mentioned toner for electrostatic image development and carriers is provided.

According to still another aspect of the invention, there is provided an image formation method comprising the steps of: forming an electrostatic latent image on a photoconductor; forming a toner image by developing the electrostatic latent image on the photoconductor using the electrostatic image developer according to claim 16; and transferring and fixing the toner image onto a recording medium.

Yet, another aspect of the invention provides an image formed by the above-mentioned image formation method.

According to the process for preparing a toner for electrostatic image development of the invention, the toner is prepared by forming aggregates comprising at least a dispersed pigment bonded to the self-dispersion type polyester resin particles by adding an aqueous solution containing a flocculant while stirring a mixture obtained by mixing at least a pigment and a self-dispersion type binder resin in water. As a result, it is made possible to easily produce a toner containing no unnecessary components such as a dispersant or surfactant for emulsifying and dispersing resins, an organic solvent and binder resin-composing monomers, which are necessary in the conventional technique. Also, in the case of a conventional method involving melting and kneading a pigment and a binder resin, the polymer may be cut because of shear stress to fluctuate the molecular weight and thus it may sometimes be impossible to obtain desired toner properties because of the fluctuation of the molecular weight distribution at the time of blend, meanwhile the invention does not cause such problems.

Further, use of two or more kinds of self-dispersion type binder resins with different number average molecular weights improves the toner properties, particularly improves the toner storage property and fixation property.

Further, the preparation of a toner using a dispersion pigment excellent in the dispersibility makes it possible to control the dispersion particle diameter of the pigment in the toner to be small and to give a toner excellent in the toner properties such as color reproducibility.

Further, since the toner for electrostatic image development of the invention is produced by the above-mentioned process, unnecessary components such as an organic solvent and binder resin composing monomers are scarcely contained and the toner is excellent in the toner properties.

Also, since the toner for electrostatic image development of the invention contains carboxylic acid as a hydrophilic group, the toner can be made to be hydrophobic by washing with an acid and excellent in environmental stability as compared with a polyester resin containing sulfonic acid group.

DESCRIPTION OF THE PREFERRED EXAMPLES

Figure 1:
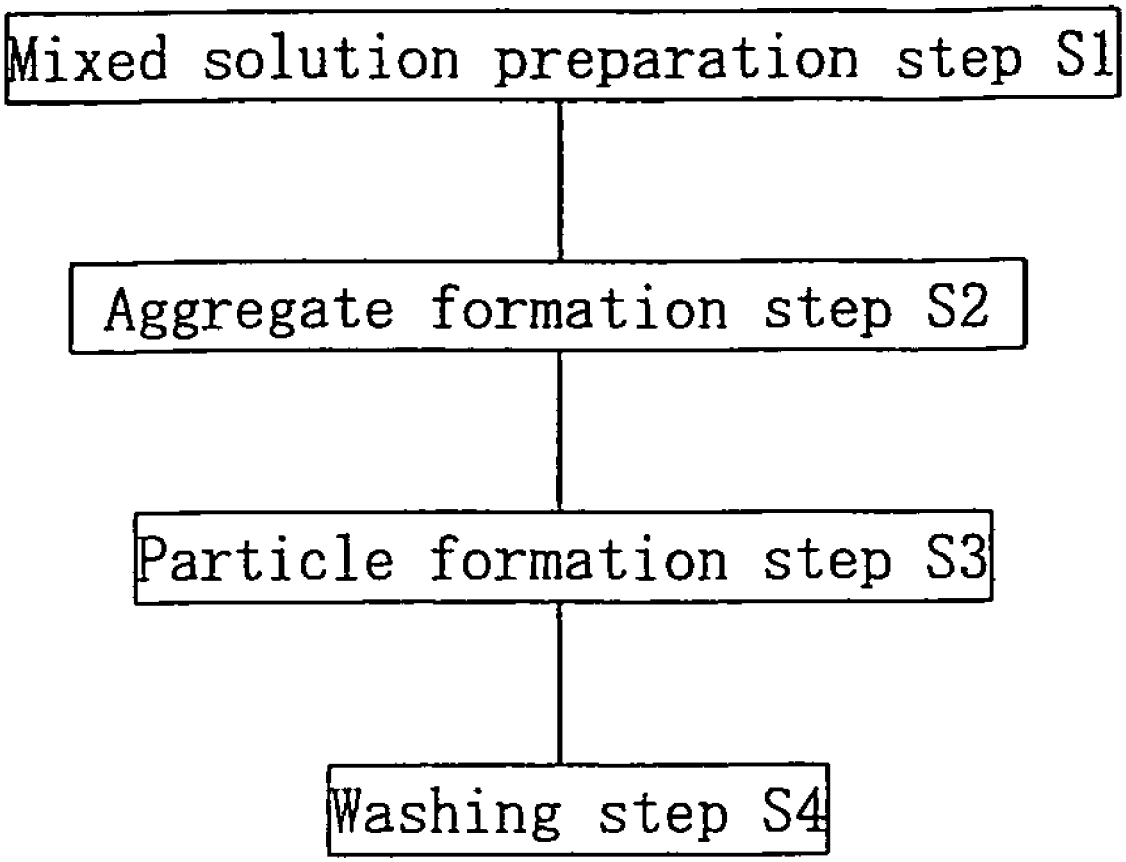
FIG. 1 is a flow chart showing a process of a toner for electrostatic image development of the invention.

A process for preparing a toner for electrostatic image development of the invention has characteristic that the above-mentioned the process for preparing a toner for electrostatic image development, the process comprising the steps of: (S1) mixing an aqueous pigment dispersion and an aqueous resin particle dispersion containing self-dispersible polyester resin particles as a binder resin to prepare a mixture; and (S2) adding a polyvalent metal salt as a flocculant to the mixture while stirring to form aggregates of the pigment bonded to the resin particles, wherein the self-dispersible polyester resin is prepared by reacting a carboxylic acid compound with an alcohol compound inclusive of a polyhydric alcohol, the carboxylic acid compound being one or more of a polycarboxylic acid having three or more carboxyl groups and its anhydride.

In the process of the invention, the self-dispersible polyester resin preferably contains two or more kinds of self-dispersible polyester resins having different number average molecular weights.

A process for preparing a toner for electrostatic image development of the invention has another characteristic that the above-mentioned self-dispersion type binder resin particles are made of two or more kinds of self-dispersion type binder resins having different number average molecular weights.

FIG. 1 is a process drawing showing the process for preparing a toner for electrostatic image development of the invention. In the toner process in this embodiment of the invention, a mixture preparation step S1, aggregate formation step S2, particle formation step S3, and washing step S4 are carried out in this order.

(Mixture Preparation Step S1)

In the mixture preparation step S1, toner components such as a separately dispersed pigment, self-dispersion type binder resin (hereinafter, sometimes referred to as binder resin or simply resin), and the like are mixed with water to produce a mixture. In the aggregate formation step S2, an aqueous solution containing a flocculant is added to the above-mentioned mixture to form a toner in form of aggregates in an aqueous medium. Further, the particle formation step S3 and the washing step S4 are carried out to obtain a toner excellent in the toner properties. Practically, in the particle formation step S3, the aqueous medium containing the aggregates is heated to granulate the aggregates. In the washing step S4, the granulated aggregates are washed and dried.

Hereinafter the above-mentioned respective steps will be described more in detail.

In the mixture preparation step S1, a pigment and a binder resin, which will be described later, are separately dispersed in water by a stirring apparatus (an emulsifier or a dispersing apparatus) to respectively produce an aqueous pigment dispersion containing a dispersible pigment and an aqueous binder resin particle dispersion containing self-dispersion type polyester binder resin particles (hereinafter, sometimes referred to as binder resin particles) and the aqueous pigment dispersion and the aqueous binder resin particle dispersion are mixed and stirred to produce a mixture containing toner components. Preferably, the aqueous binder resin particle dispersion and the aqueous pigment dispersion are mixed at a proper ratio to contain 80 to 99% by weight of the binder resin on the basis of the solid matter concentration and 0.1 to 20% by weight of the dispersible pigment and stirred at a room temperature for 1 to 5 hours by a stirring apparatus to obtain the mixture. Further, in the mixture preparation step S1, an aqueous wax fine particle dispersion containing natural and/or synthesized wax fine particles emulsified in water may be mixed with the above-mentioned mixture and the ratio is about 0.1 to 20% by weight on the basis of the solid matter concentration.

(Aggregate Formation Step S2)

In the aggregate formation step S2, aggregates containing toner components are formed by adding a flocculant in a prescribed amount, for example 0.5 to 20 parts by weight, to 100 parts by weight of the toner components of the mixture containing the toner components such as the pigment and the binder resin particles (in some cases also containing wax fine particles). Accordingly, unnecessary components other than the toner components, for example, an organic solvent, and binder resin composing monomers are not contained in the toner.

This step S2 is preferable to be carried out at room temperature and may be carried out in a condition of heating to a temperature near the glass transition temperature (Tg) of the binder resin. In this case, if self-dispersion type polyester binder resin particles are made of two or more kinds of self-dispersion type binder resins having different number average molecular weights, heating may be carried out to a temperature near the glass transition temperature (Tg) of the binder resin having the lowest glass transition temperature among the two or more kinds of the resins.

Further, in the step S2, it is preferable to stir the mixture by mechanical shear force by using a stirring apparatus since aggregates in form of particles with uniform particle diameter and shape can easily be obtained.

Further, it is also possible to carry out aggregate formation by forming aggregates using the binder resin having the lower number average molecular weight (hereinafter, sometimes referred to as molecular weight for short) and the pigment and, if necessary, wax dispersion particles and successively adding the resin particles with higher molecular weight and thereby bonding the resin added later to the surfaces of the previously formed aggregate particles.

Addition of this step gives storage stability of the toner since the resin with a higher molecular weight exists in the surface layer of the toner to be produced and the resin with a lower molecular weight existing in the inner shells guarantees the fixation property (particularly effective for low temperature fixation). Further, the toner surface property is made intentionally controllable. For example, a toner having a conductive substance such as carbon black in the toner surface layer and a toner having a color pigment (Cyan, Magenta, and Yellow) in the surface layer have different chargeability and it is therefore needed to separately design the developers. Since the charging property is dominantly affected in accordance with the toner surface, it is made possible to lessen the chargeability difference among pigments by forming a layer for preventing the pigments from direct exposure to the surface. It is also expected that formation of the resin layer on the surface can cause an advantageous side effect to improve the spent of the carrier by the wax.

In this aggregate formation step S2, it is possible to mix a prescribed amount (e.g. 1 to 5% by weight in the entire amount of resins used) of an aqueous binder resin particle dispersion containing the binder resin particles but no pigment. In this case, a prescribed amount of the resin in the aqueous binder resin particle dispersion to be mixed in the mixture preparation step S1 is previously decreased. Further, to prevent re-flocculation of the aggregates, a surfactant may be added and sodium hydroxide for adjusting the pH to be 8 or higher may be added.

(Particle Formation Step S3)

In the particle formation step S3, the water medium containing the obtained aggregates is heated to form particles of the aggregates with approximately uniform particle diameter and shape. In this case, it is preferable to carry out the heating to the glass transition temperature of the binder resin or to the highest glass transition temperature in the case of using two or more kinds of binder resins with different glass transition temperatures so as to adjust the particle diameter to be 1 to 20 μm. In such a manner, toner particles with approximately uniform particle diameter and shape can be obtained.

Further, in the particle formation step S3, an aqueous binder resin particle dispersion containing the binder resin for controlling the toner shape may additionally be added to again form aggregates. In this case, it is allowed to add a surfactant to prevent re-flocculation of the aggregates and add sodium hydroxide to adjust pH to be 8 or higher. In this case, it is also desirable to previously decrease a prescribed amount of the resin of the aqueous binder resin particle dispersion to be added in the previous mixture preparation step S1.

(Washing Step S4)

In the washing step S4, the mixture containing the toner (aggregates) is cooled to, for example, room temperature and filtered to remove the supernatant solution and the separated toner is washed with water. For the washing, it is preferable to use water having conductivity of 20 μS/cm or lower (preferably 10 μS/cm or lower) and it is also preferable to wash the toner until the conductivity of the supernatant solution of the washing water used for washing the toner is lowered to 50 μS/cm or lowered. The washing of the toner with water may be carried out in batches or continuously. The washing of the toner with water is carried out for removing unnecessary components such as impurities which may affect the chargeability of the toner and unneeded flocculant irrelevant to flocculation, other than the toner components and accordingly the toner free of unnecessary components can easily be produced. During the washing step with water, a step of washing with water at pH 6 or lower may be added at least once and accordingly impurities can be removed more sufficiently. After that, the toner washed in such a manner is separated from the washing water by filtration and may be dried by a vacuum drying apparatus. Additionally, a desirable additive (e.g. a charge controlling agent, a release agent, and an extrapolating agent) may be added to the toner obtained after drying.

[Description of Toner Components]

(Self-Dispersion Type Binder Resin Particles)

In this invention, a resin composing the self-dispersion type binder resin particles is not particularly limited if the resin can be dispersed and kept in dispersed state in water and conventionally known resins, for example, polyester resins, vinyl type copolymer resins, polyurethane resins, and epoxy resins can be exemplified as a usable resin and these resins may be used alone or a plurality of them may be used in combination.

Further, two or more kinds of resins having different number average molecular weights may be used. In this case, even a single kind resin, a plurality of kinds of resins different from one another in one or a plurality of properties such as the number average molecular weight, monomer composition, and the like may be used. Also, resin mixtures containing 50% by weight or higher of at least two kinds of resins selected from the exemplified polyester resins, vinyl type copolymer resins, polyurethane resins, and epoxy resins as a binder resin and as the balance, less than 50% by weight of one or more kinds of synthetic resins fusible by heating, besides the exemplified resins may be used. In this case, the respective resins to be used are preferable to be synthetic resins having compatibility and fusible by heating. The binder resins are further preferable to have hydroxyl groups in the main chains.

With respect to two or more kinds of the binder resins having different number average molecular weights in the invention, the lowest number average molecular weight is 2000 or higher, preferably 2500 or higher, and more preferably 3000 or higher. Also, in the case the difference of the number average molecular weights of these resins is set in a range of 1000 or higher, the toner properties can be improved more, particularly the toner storage property and fixation property are made excellent. If the lowest number average molecular weight is 2000 or lower, the storage property and the fixation property tend to be lowered.

The binder resin to be used in the invention is preferably a polyester resin and a vinyl type copolymer resin and more particularly preferably a resin containing a polyester resin as a main component, in consideration of the powder fluidity, the lower temperature fixation property, and the secondary color reproducibility of toner particles to be obtained. The ratio of the polyester resin in the entire resins composing the binder resin is preferably 50% by weight or higher, more preferably 80% by weight or higher, and even more preferably 90% by weight or higher. That is for improving the reproducibility of the color as a toner and developing the function of the adhesive strength to paper or the like. Hereinafter, the polyester resin will be described.

The polyester resin to be used for the binder resin particles can be obtained by condensation polymerization of an acid component and an alcohol component and polyester resins obtained by using polyfunctional carboxylic acids as the acid component and polyhydric alcohols used as the alcohol component are preferable.

Examples of the above-mentioned polyfunctional carboxylic acids are aromatic dicarboxylic acids such as terephthalic acid, isophthalic acid, o-phthalic acid, 1,5-naphthalenedicarboxylic acid, 2,6-naphthalenedicarboxylic acid, anthracenedipropionic acid, anthracenedicarboxylic acid, diphenic acid, sulfoterephthalic acid, 5-sulfoisophthalic acid, 4-sulfophthalic acid, 4-sulfonaphthalene-2,7-dicarboxylic acid, 5(4-sulfophenoxy)isophthalic acid, and their metal salts and ammonium salts; aromatic oxycarboxylic acids such as p-oxybenzoic acid and p-(hydroxyethoxy)benzoic acid; aliphatic dicarboxylic acids such as succinic acid, adipic acid, azelaic acid, sebacic acid, and dodecanedicarboxylic acid; aliphatic unsaturated polyfunctional carboxylic acids such as fumaric acid, maleic acid, itaconic acid, and mesaconic acid; aromatic unsaturated polyfunctional carboxylic acids such as phenylenediacrylic acid; alicyclic dicarboxylic acids such as hexahydrophthalic acid and tetrahydrophthalic acid; and tri- or higher polyfunctional carboxylic acid such as trimellitic acid, trimesic acid, and pyromellitic acid and/or their acid anhydrides and they may be used alone or a plurality of them may be used in combination.

In the invention, the above-mentioned acid components may be those containing monocarboxylic acids. The monocarboxylic acids are preferably aromatic monocarboxylic acids. Examples of the aromatic monocarboxylic acids are benzoic acid, chlorobenzoic acid, bromobenzoic acid, p-hydroxybenzoic acid, naphthalenecarboxylic acid, anthracenecarboxylic acid, 4-methylbenzoic acid, 3-methylbenzoic acid, salicylic acid, thiosalicylic acid, phenylacetic acid, their lower alkyl esters, sulfobenzoic acid monoammonium salt, sulfobenzoic acid monosodium salt, cyclohexylaminocarbonylbenzoic acid, n-dodecylaminocarbonylbenzoic acid, tert-butylbenzoic acid, and tert-butylnaphthalenecarboxylic acid.

In the above-mentioned acid components, the content of the polyfunctional carboxylic acid is 70% by mole or higher, preferably 80% by mole or higher, and more preferably 90% by mole or higher and aromatic polyfunctional carboxylic acids are preferable as the polyfunctional carboxylic acids. Further, as the aromatic polyfunctional carboxylic acid, terephthalic acid and isophthalic acid are preferable to be contained and the content of terephthalic acid is preferably 40 to 95% by mole, more preferably 60 to 95% by mole, and even more preferably 70 to 90% by mole in the acid components. The content of isophthalic acid is preferably 5 to 60% by mole in the acid components. Further, the total content of terephthalic acid and isophthalic acid is preferably 80% by mole or higher and more preferably 90% by mole or higher in the acid components. In this invention, as the polyfunctional carboxylic acids, it is particularly preferable to contain one or a plurality of tri- or higher polyfunctional carboxylic acids such as trimellitic acid, trimesic acid and pyromellitic acid, and acid anhydrides of these polyfunctional carboxylic acids such as pyromellitic acid anhydride, cyclohexane-1,2,3,4-tetracarboxylic acid-3,4-dihydride, ethylene glycol bisanhydrotrimellitate and the content of them is preferably 0.5 to 8% by mole and particularly preferably 0.5 to 20% by mole in the acid components. When the monocarboxylic acid is contained in the acid components, the content is preferably 2 to 25% by mole, more preferably 5 to 20% by weight. The reason for that is because the self-dispersibility of the polyester resins can be retained.

In this invention, examples of the above-mentioned polyhydric alcohols may be aliphatic polyhydric alcohols, alicyclic polyhydric alcohols, and aromatic polyhydric alcohols. Examples of the aliphatic polyhydric alcohols are aliphatic diols such as ethylene glycol, propylene glycol, 1,3-propane diol, 2,3-butanediol, 1,4-butanediol, 1,5-pentanediol, 1,6-hexanediol, neopentyl glycol, diethylene glycol, dipropylene glycol, 2,2,4-trimethyl-1,3-pentanediol, polyethylene glycol, polypropylene glycol and polytetramethylene glycol; and triols and tetraols such as trimethylol ethane, trimethylol propane, glycerin, and pentaerythritol. Examples of the alicyclic polyhydric alcohols are 1,4-cyclohexanediol, 1,4-cyclohexanedimethanol, spiroglycol, hydrated bisphenol A, hydrated bisphenol A ethylene oxide adduct and propylene oxide adduct, tricyclododecanediol, and tricyclodecanedimathanol. Examples of the aromatic polyhydric alcohols are p-xylene glycol, m-xylene glycol, o-xylene glycol, 1,4-phenylene glycol, 1,4-phenylene glycol ethylene oxide adduct, bisphenol A, ethylene oxide adduct and propylene oxide adduct of bisphenol A. Also, examples of the polyester polyols are lactone type polyester polyols obtained by ring opening polymerization of lactones such as ϵ-caprolactone.

In this invention, as the alcohols component, the polyhydric alcohols may contain monoalcohols. Examples of the monoalcohols are aliphatic alcohols, aromatic alcohols, and alicyclic alcohols.

In the alcohol components composing the polyester resins of the invention, the content of the polyhydric alcohols is 50% by mole or higher, preferably 70% by mole or higher, more preferably 80% by mole or higher, and even more preferably 90% by mole or higher. The aliphatic diols and/or alicyclic diols are preferable to be contained as the polyhydric alcohols. Preferable examples of the aliphatic diols are ethylene glycol, propylene glycol and 2,3-butanediol. Among them, ethylene glycol and propylene glycol are more preferable. Preferable examples of the alicyclic diols are tricyclodecanedimethanol, cyclohexanediol, and cyclohexanedimethanol. Particularly, in the invention, ethylene glycol and/or propylene glycol are contained in an amount of 50% by mole or higher, more preferably 60% by mole or higher, and even more preferably 70% by mole in the alcohol components.

The polyester resins composing the binder resin particles are, as described above, obtained by condensation polymerization of di- or higher polyfunctional carboxylic acids and di- or higher polyhydric alcohols as raw materials and the purpose is for widening the molecular weight distribution of the polyester resins but not for gelling the resin. Gelation of the resin makes the resin difficult to be taken out of a polymerization apparatus and considerably lowers the productivity. The polyester resins to be used in the invention are practically free from gelation and more particularly, the polyester resins have a content of a chloroform-insoluble component of not higher than 0.5% by weight and preferably not higher than 0.25% by weight and an acid value of 40 mgKOH/g or lower and preferably 30 mgKOH/g or lower.

In the invention, the glass transition temperature (or the softening point) of the polyester resins composing the binder resin particles is preferably 40 to 80° C. (80 to 150° C.), more preferably 45 to 80° C. (85 to 150° C.), and even more preferably 50 to 75° C. (80 to 145° C.). In the case the glass transition temperature and the softening temperature is lower than 40° C. and 80° C., respectively, the toner obtained by the polyester resin particles tends to cause blocking and has a problem of storage stability. On the other hand, if the glass transition temperature exceeds 80° C., the toner tends to cause off-set, particularly in the case of color printing by overlaying colors, this problem tends to become significant, and if the softening point exceeds 150° C., the toner obtained by the polyester resin particles has a problem in the fixation property, and requires a fixation roll to be heated to a high temperature and therefore, a material for the fixation roll and a material for a substrate of a transfer medium are limited.

The hydrophilic groups to be contained in the main chains of the binder resins are preferably ionic groups and among them, anionic groups are particularly preferable. Practically preferable examples of the hydrophilic groups are carboxyl group, sulfonic acid group, phosphoric acid group, phosphonic acid group, phosphinic acid group, ammonium salts and metal salts of these groups and among them, carboxylic acid alkali metal salts and carboxylic acid ammonium salts are more preferable. In the case of polyester resins, at the time of introducing carboxylic acid alkali metal salts and carboxylic acid ammonium salts, they can be introduced by a method involving steps of introducing the above exemplified polyfunctional carboxylic acids such as trimellitic acid and/or their acid anhydrides in a reaction system in the terminal period of polyester polymerization to add carboxyl groups to the polymer terminals and/or molecular chains and neutralizing the carboxylic acids and/or acid anhydrides with ammonia or sodium hydroxide to convert them to carboxylic acids. The ionic groups provide water-dispersibility to the polyester resins and at the time of polymerization for producing the polyesters, the counter cation of the ionic group-containing monomers is preferable to be mono-valent cation. The self-dispersion type polyester resins having the carboxylic acid salts as hydrophilic groups have an advantage that they can be made hydrophobic by a washing method to be carried out thereafter.

Next, a method of obtaining particles having a prescribed average particle diameter and particle diameter distribution from the self-dispersion type binder resin having ionic groups will be described. In the case of polyester resins, ionic group-containing polyester resins have water-dispersibility. An aqueous micro-dispersion of an ionic group-containing polyester resin can be produced by a conventionally known method. For example, there is a method of producing it by respectively heating an ionic group-containing polyester resin and a water-soluble organic compound to 50 to 200° C., mixing them, and then adding water to the mixture.

There is also another method of producing it by adding a mixture of an ionic group-containing polyester resin and a water-soluble organic compound (e.g. a compound to be a counter cation) to water, heating the obtained mixture at 40 to 120° C., and thereby dispersing the resin and the compound.

Further, there is another method of producing it by adding an ionic group-containing polyester resin to a mixture of water and a water-soluble organic compound, heating the obtained mixture at 40 to 100° C., and stirring the mixture.

Examples usable as the above-mentioned water-soluble organic compound are solvents such as ethanol, butanol, isopropanol, ethyl cellosolve, butyl cellosolve, dioxane, tetrahydrofuran, acetone, and methyl ethyl ketone.

The average particle diameter of the binder resin particles such as the aqueous micro-dispersion of the polyester resin is 0.2 μm or smaller, preferably 0.01 to 0.15 μm, and more preferably 0.01 to 0.1 μm. If the average particle diameter of the binder resin particles is larger than 0.2 μm, the flocculated particles become so large that control of them properly to the toner size might be difficult.

(Pigment)

In the invention, conventionally know pigments can be used and any pigment such as blue, brown, cyan, green, violet, magenta, red and yellow pigments can be used and their mixtures are also usable. Practically, the pigments may include anthraquinone type pigments, phthalocyanine blue type pigments, phthalocyanine green type pigments, diazo type pigments, monoazo type pigments, pyranthrone type pigments, perylene type pigments, heterocyclic yellow, quinacridone, indigoid type pigments, and thioindigoid type pigments. Examples of the anthraquinone type pigments may be Pigment red 43, Pigment red 194 (Perinone red), Pigment red 216 (brominated Pyranthrone red), and Pigment red 226 (Pyranthrone red). Examples of the phthalocyanine blue type pigments are copper phthalocyanine glue and its derivative, Pigment blue 15. Examples of the perylene type pigments are Pigment red 123 (Vermillion), Pigment red 149 (Scarlet), Pigment red 179 (Maroon), Pigment red 190 (Red), Pigment violet, Pigment red 189 (Yellow shade red), and Pigment red 224. Examples of the heterocyclic yellow type pigments are Pigment yellow 117 and Pigment yellow 138. Examples of quinacridone type pigments are Pigment orange 48, Pigment orange 49, Pigment red 122, Pigment red 192, Pigment red 202, Pigment red 206, Pigment red 207, Pigment red 209, Pigment violet 19 and Pigment violet 42. Examples of the thioindigoid type pigments are Pigment red 86, Pigment red 87, Pigment red 88, Pigment red 181, Pigment red 198, Pigment violet 36, and Pigment red 38. Carbon black to be produced by various methods can be used as black color pigments.

The above-mentioned pigments may be dispersed in water by using a dispersant such as a surfactant. In this case, as the dispersant are preferably anionic surfactants and nonionic surfactants and are more preferably anionic surfactants. Use of the dispersant makes the pigments easy to be dispersed in water, makes the dispersion diameter of the pigments in a toner small, and makes it possible to produce a toner with excellent toner properties. Further, an unnecessary dispersant can be removed by the washing step.

One kind pigment may be used alone or two or more kinds of pigments may be used in combination. Further, in the case two or more kinds of pigments are used in combination, same color type pigments may be used in combination and a plurality of types of pigments may be used in combination. The content of the pigments can be selected in a wide range in accordance with the required toner properties in the invention and it is preferably 0.1 to 20% by weight and more preferably 0.1 to 15% by weight to 100% by weight of the binder resin. If it is lower than 0.1% by weight, the image density of the formed images hardly becomes high and it exceeds 20% by weight, it becomes difficult to secure the dispersibility of the pigments in the images to be formed.

(Wax Fine Particles)

In the invention, wax fine particles to be one of toner components may be added. Conventionally known waxes can be used as the fine particles and for example, natural waxes such as carnauba wax and rice wax; synthetic waxes such as polypropylene wax, polyethylene wax, and Fischer-Tropsch wax; coal waxes such as montan wax; alcohol type waxes; ad ester type waxes. One kind wax may be used alone and two or more waxes may be used in combination. Wax fine particles are mixed to the mixture in the mixture preparation step S1 and at that time, it is preferable to add previously produced aqueous wax fine particle dispersion by mixing and emulsifying a wax in water or an encapsulated wax obtained by encapsulating the surface of the wax with a resin to the mixture. The reason for that is because if the encapsulated wax is added, the wax is not exposed to the toner surface in the toner process in which no resin layer is formed on the toner surface and therefore the spent of wax to the carrier can be improved. In the case where a wax is included in the toner components, the content is preferably 0.5 to 20% by weight and more preferably 1 to 10% by weight to 100% by weight of the binder resin.

(Additives)

In this invention, besides the above-mentioned toner components, based on the necessity, proper amounts of additives to be added commonly to a toner, such as a charge controlling agent and a release agent may be added to the toner dried after the washing step.

Further, conventionally known extrapolating agents may be added to the toner dried after the washing step to reform the surface of the toner particles. Conventionally known extrapolating agents may be used as the extrapolating agents and for example, inorganic particles dispersible in water such as silica and titanium oxide can be exemplified. These inorganic particles have an average particle diameter of 1 μm or smaller, preferably 0.01 to 0.8 μm and one or more kinds of inorganic particles may be used in combination. Further, a silicone resin may be added to the extrapolating agents to reform the surface. The addition amount of the extrapolating agents is preferably 1 to 10 part by weight to 100 part by weight of the toner particles.

The toner to be obtained by the above-mentioned process of the invention has an average particle diameter preferably 10 μm or smaller, more preferably 2 to 9 μm, and even more preferably 3 to 8 μm. If the average particle diameter exceeds 10 μm, the particle size distribution becomes broad and dispersion of the chargeability becomes wide, in relation to the toner process and it cause image disorder.

The toner to be obtained by the above-mentioned process of the invention may be used for a one-component type developer or a two-component type developer. In the case the toner is used for a one-component type developer, the toner is used alone without using a carrier to carry out image formation by sticking and transferring the toner on a developer sleeve by generating friction charge by the sleeve using a blade and a fur brush.

On the other hand, in the case the toner is used for a two-component type developer, the toner is used together with a carrier. Conventionally known carriers may be used as the carrier and for example, carriers made of a single element such as iron, copper, zinc, nickel, cobalt, manganese, magnesium, and chromium, and composite ferrites, and also carrier core particles surface coated with coating materials can be exemplified. As the coating materials are usable those conventionally known ones and examples are polytetrafluoroethylene, monochlorotrifluoroethylene polymers, poly(vinylidene fluoride), silicone resins, polyester resins, di-tert-butylsalicylic acid metal compounds, styrene type resins, acrylic resins, polyacids, polyvinyl-ral, Nigrosine, amino acrylate resin, basic dyes, lakes of basic dyes, silica fine powder, and alumina fine powder and, preferably, they may properly be selected in accordance with the toner components. The coating materials may be used alone or two or more of them may be used in combination. The average particle diameter of the carrier is preferably 10 to 100 μm and more preferably 20 to 80 μm.

[Explanation of Flocculant]

Conventionally known flocculants may be used as the flocculant to be used in the aggregate formation step in the toner process of the invention and for example, electrolytic substances and organic compounds having ion polarity opposite to that of the pigment can be used. As described above, since the binder resin and the pigment are preferable to have ionic groups and/or ionizable groups in their surfaces, polyvalent metal salts capable of forming ion bonds with such binder resin and pigment are preferable. Further, magnesium sulfate and aluminum sulfate easy to be dissolved in water are more preferable since they are easy to be washed out with water. Between them, magnesium sulfate is particularly preferable. The reason for that is because the valance of the ion of the magnesium salt is di-valence, and in the case it is used as a flocculant, the flocculation speed is moderate as compared with the case of using the aluminum salt having tri-valence and the magnesium salt is optimum for controlling the particle diameter. It is also possible to use organic type flocculants such as dimethylaminoethyl (2,2-dimethylol)propionate as the flocculant.

The use amount of the flocculant is 0.5 to 20 part by weight, preferably 0.5 to 18 part by weight, and more preferably 1.0 to 18 part by weight. If the use amount of the flocculant is less than 0.5 part by weight, flocculation does not take place and granulation becomes impossible, and if it is more than 20 part by weight, it causes disadvantageous effects such that the aggregates become too large.

[Explanation of Water]

The water to be used in the washing step in the toner process of the invention is preferable to have a conductivity of 20 μS/cm or lower. Such water can be obtained by conventionally known methods such as an activated carbon method, an ion exchange method, a distillation method, and a reverse osmosis method, and by combining a plurality of these methods. The temperature of the water at the time of washing is preferably equal to or lower than the lowest glass transition temperature of the binder resins in terms of prevention from re-flocculation.

[Explanation of Stirring Apparatus]

In the aggregate formation step in the toner process of the invention, it is preferable to use a stirring apparatus for stirring the mixture. Conventionally known emulsifying apparatuses and dispersing apparatuses can be used as the stirring apparatus and preferable apparatuses are those which can receive toner components and an aqueous medium in batches or continuously, have heating means, are capable of producing a toner in form of pigment-containing binder resin particles by mixing the toner components and the aqueous medium under heating condition and discharging the toner in batches or continuously. Also, the emulsifying apparatus and the dispersing apparatus are preferable to be capable of applying shear force to the mixture of the toner and the aqueous medium since they make it easy to form the formed aggregates into particles with uniform particle diameter and shape. Further, the emulsifying apparatus and the dispersing apparatus are preferable to have at least one of a stirring means and a rotating means and therefore be capable of mixing the toner and the aqueous medium under a stirring or rotating condition. The emulsifying apparatus and the dispersing apparatus are preferable to have a mixing container for mixing the toner and the aqueous medium and a heat insulating means for the container.

Practically, examples usable as the emulsifying apparatus and the dispersing apparatus are batch type emulsifying apparatuses such as ULTRA TURRAX (trade name: manufactured by IKA Japan Co., Ltd.), POLYTRON HOMOGENIZER (trade name: manufactured by Kinematica), TK AUTOHOMO-MIXER (trade name: manufactured by Tokushu Kika Kogyo Co., Ltd.), and MAX BLEND (trade name: manufactured by Sumitomo Heavy Industries, Ltd.); continuous type emulsifying apparatuses such as EBARA MILDER (trade name: manufactured by Ebara Corp.), TK PIPELINE HOMO-MIXER (trade name: manufactured by Tokushu Kika Kogyo Co., Ltd.), TK HOMOMIC LINE LOW (trade name: manufactured by Tokushu Kika Kogyo Co., Ltd.), FILMIX (trade name: manufactured by Tokushu Kika Kogyo Co., Ltd.), COLLOID MILL (trade name: manufactured by Shinko Pantec Co., Ltd.), SLASHER (trade name: manufactured by Mitsui-Miike Kakoki Co., Ltd.), TRIGONAL WET FINE PULVERIZER (trade name: manufactured by Mitsui-Miike Kakoki Co., Ltd.), CAVITRON (trade name: manufactured by EUROTEC, LTD.), and FINE FLOW MILL (trade name: manufactured by Pacific Machinery & Engineering Co., Ltd.); CLEAMIX (trade name: manufactured by M. Technique Co., Ltd.) and FILMIX (trade name: manufactured by Tokushu Kika Kogyo Co., Ltd.).

EXAMPLES

The invention will be described more in detail with reference to Examples and Comparative Examples, however it is not intended that the invention be limited to the illustrated embodiments. Modifications and substitutions to specific process conditions and structures can be made without departing from the spirit and scope of the invention. The acid value, the glass transition temperature, and the number average molecular weight of the self-dispersion type polyester were measured by the following methods.

[Acid Value]

The acid value was measured according to JIS K 0070.

[Glass Transition Temperature]

A peak chart was measured by heating a sample to 200° C. by using a differential scanning calorimeter (DSC 210, manufactured by Seiko Instruments Inc.), cooling the sample to 0° C. from 200° C. at a cooling rate of 10° C./min, and again heating the sample at a heating rate of 10° C./min and the glass transition temperature was defined as the temperature at the crossing point of the extended base line under the maximum peak temperature and the tangent line showing the maximum slant from the rise up pat of the peak to the apex of the peak.

[Number Average Molecular Weight]

Molecular weight distribution was measured by the following gel permeation chromatograph (GPC) and the number average molecular weight was calculated from the measured molecular weight.

Measurement apparatus: CO-8010 (manufactured by Tosoh Corp.)

Analysis column: GMHLX+G3000HXL (manufactured by Tosoh Corp.)

Sample concentration: 0.5 g/100 mL tetrahydrofuran

Eluent: tetrahydrofuran (40° C.)

Flow speed of eluent: 1 ml/min.

Standard samples: monodispersed polystyrene

[Synthesis of Copolymer Polyester Resin to be Used Self-dispersion Type Binder Resin Particles]

(Copolymer Polyester Resin 1)

Dimethyl terephthalate 137 part by weight, dimethyl isophthalate 55 part by weight, ethylene glycol 68 part by weight, bisphenol A ethylene oxide adduct (average molecular weight 350) 175 part by weight and as a catalyst, tetrabutoxy titanate 0.1 part by weight were loaded to an autoclave equipped with a thermometer and a stirrer and heated at 150 to 220° C. for 180 minutes to carry out ester-interchange reaction and successively heated to 240° C. and then, the pressure in the reaction system was gradually decreased to 10 mmHg after 30 minutes and the reaction was continued for 70 minutes. After that, the gas in the autoclave was replaced with nitrogen gas and the pressure was adjusted to atmospheric pressure. The temperature was kept at 200° C. and trimellitic anhydride 2 part by weight was added and reaction was carried out further for 70 minutes to obtain a copolymer polyester resin 1.

The acid value of the obtained copolymer polyester resin 1 was measured to find it was 15 KOHmg.

(Copolymer Polyester Resin 2)

At first, 1,5-naphthalene dicarboxylic acid methyl ester 38 part by weight, dimethyl terephthalate 96 part by weight, dimethyl isophthalate 58 part by weight, ethylene glycol 136 part by weight, and as a catalyst, tetrabutoxy titanate 0.1 part by weight were loaded to an autoclave equipped with a thermometer and a stirrer and heated at 150 to 220° C. for 180 minutes to carry out ester-interchange reaction. Successively, the reaction mixture was heated to 240° C. and then, the pressure in the reaction system was gradually decreased to 10 mmHg after 30 minutes and the reaction was continued for 70 minutes. After that, the gas in the autoclave was replaced with nitrogen gas and the pressure was adjusted to atmospheric pressure. The temperature was kept at 200° C. and trimellitic anhydride 10 part by weight was added and reaction was carried out further for 70 minutes to obtain a copolymer polyester resin 2.

The acid value of the obtained copolymer polyester resin 2 was measured to find it was 14 KOHmg.

(Copolymer Polyester Resin 3)

Dimethyl terephthalate 112 part by weight, dimethyl isophthalate 76 part by weight, 5-sodium sulfodimethyl isophthalate 6 part by weight, ethylene glycol 96 part by weight, propylene glycol 50 part by weight, and tetrabutoxy titanate 0.1 part by weight were loaded to an autoclave equipped with a thermometer and a stirrer and heated at 180 to 230° C. for 120 minutes to carry out ester-interchange reaction. Successively, the reaction system was heated to 250° C. and then, the pressure in the reaction system was adjusted to 1 to 10 mmHg and the reaction was continued for 60 minutes to obtain a copolymer polyester resin 3.

The acid value of the obtained copolymer polyester resin 3 was measured to find it was 0.1 KOHmg.

(Copolymer Polyester Resin 4)

Terephthalic acid 199 part by weight, isophthalic acid 465 part by weight, 2,2-dimethyl-1,3-propanediol 468 part by weight, 1,5-pentanediol 156 part by weight and as a catalyst, tetrabutoxy titanate 0.41 part by weight were loaded to a reaction container equipped with a stirrer, a condenser, and a thermometer and heated it to from 160 to 230° C. for 4 hours to carry out esterification reaction. Successively, the reaction system was gradually decreased to 5 mmHg in 20 minutes and further the condensation polymerization reaction was carried out for 40 minutes at 260° C. under vacuum of 0.3 mmHg. Under nitrogen current, the reaction system was cooled to 220° C. and trimellitic anhydride 23 parts by weight and ethylene glycol bisanhydrotrimellitate 16 parts by weight were added and reaction was carried out further for 30 minutes to obtain a copolymer polyester resin 4. The acid value of the obtained copolymer polyester resin 4 was measured to find it was 22 KOHmg.

(Copolymer Polyester Resin 5)

Terephthalic acid dimethyl ester 96 parts by weight, isophthalic acid dimethyl ester 96 parts by weight, ethylene glycol 72 parts by weight, neopentyl glycol 103 parts by weight, and tetrabutoxy titanate 0.1 part by weight were loaded to an autoclave equipped with a thermometer and a stirrer and heated at 150 to 220° C. for 180 minutes to carry out ester-interchange reaction. Successively, the reaction system was heated to 240° C. and then, the pressure in the reaction system was adjusted to 10 mmHg after 30 minutes and the reaction was continued for 60 minutes. After that, the gas in the autoclave was replaced with nitrogen gas to adjust the pressure in the autoclave to be atmospheric pressure. While the temperature was kept at 200° C., trimellitic anhydride 4 parts by weight was added and reaction was carried out for 60 minutes to obtain a copolymer polyester resin 5. The acid value of the obtained copolymer polyester resin 5 was measured to find it was 25 KOHmg.

(Copolymer Polyester Resin 6)

Terephthalic acid 49.8 parts by weight, isophthalic acid 116.2 parts by weight, 2-methyl-1,3-propanediol 58.5 parts by weight, 1,4-cyclohexanedimethanol 51.1 parts by weight, and tetrabutoxy titanate 0.1 part by weight were loaded to 3L 4-neck an autoclave equipped with a thermometer and a stirrer and gradually heated to 235° C. for 4 hours to carry out esterification reaction. After that, reduced pressure initial polymerization was carried out and simultaneously the temperature was heated to 250° C. to carry out polymerization. When an aimed molecular weight was obtained, the reaction system was gradually cooled to 220° C. in nitrogen atmosphere. Next, ethylene glycol bistrimellitate dianhydride 2 parts by weigh and trimellitic anhydride 1.8 parts by weight were successively added and the reaction system was continuously stirred at 200 to 230° C. for 1 hour under nitrogen atmosphere to obtain a copolymer polyester resin 6. The acid value of the obtained copolymer polyester resin 6 was measured to find it was 23 KOHmg.

The glass transition temperatures and number average molecular weights of the obtained copolymer polyester resins 1 to 6 are shown in Table 1. The glass transition temperatures were measured by DSC (differential scanning calorimetry) and the number average molecular weights were measured by GPC (gel permeation chromatography).

TABLE 1

| | Glass transition temperature (° C.) | Number average molecular weight |
|---|---|---|
| Copolymer polyester resin 1 | 64 | 7800 |
| Copolymer polyester resin 2 | 65 | 3500 |
| Copolymer polyester resin 3 | 58 | 3100 |
| Copolymer polyester resin 4 | 60 | 5800 |
| Copolymer polyester resin 5 | 58 | 2100 |
| Copolymer polyester resin 6 | 39 | 1900 |

[Aqueous Copolymer Polyester Resin Micro-dispersion 1]

The above-mentioned copolymer polyester resin 1 100 parts by weight, butanol 48 parts by weight, methyl ethyl ketone 12 parts by weight, and isopropanol 20 parts by weight were loaded to a 10 L four neck separable flask equipped with a thermometer, a condenser, and a stirring blade and stirred at 70° C. for dissolution. Further, an aqueous 1N ammonia solution 270 parts by weight was added to be equivalent to the acid value of the copolymer polyester resin 1 and the resulting solution was kept at 70° C. and stirred for 30 minutes and after that, while the solution being stirred, water at 70° C. 300 parts by weight was added to obtain water micro-dispersion of the copolymer polyester resin 1. The obtained water micro-dispersion was loaded to a flask for distillation and the pressure in the flask was reduced at a temperature of 70° C. by a vacuum pump to remove the organic solvent. Finally, the solid matter was adjusted with deionized water to obtain a desolvated aqueous copolymer polyester resin micro-dispersion 1 having a solid matter concentration of 30%. The average particle diameter of the aqueous copolymer polyester resin micro-dispersion 1 was 0.095 μm. The volume average particle diameter was measured by using a laser diffraction scattering type particle distribution measurement apparatus (MICROTRACK UPA-EX150, manufactured by Nikkiso Co., Ltd.).

[Aqueous Copolymer Polyester Resin Micro-Dispersion 2]

Aqueous copolymer polyester resin micro-dispersion 2 was obtained in the same manner as the above-mentioned aqueous copolymer polyester resin micro-dispersion 1, except that the copolymer ester 2 was used. The average particle diameter of the aqueous copolymer polyester resin micro-dispersion was 0.080 μm.

[Aqueous Copolymer Polyester Resin Micro-dispersion 3]

Aqueous copolymer polyester resin micro-dispersion 3 was obtained in the same manner as the above-mentioned aqueous copolymer polyester resin micro-dispersion 1, except that the copolymer ester 3 was used. The average particle diameter of the aqueous copolymer polyester resin micro-dispersion was 0.2 μm.

[Aqueous Copolymer Polyester Resin Micro-dispersion 4]

Aqueous copolymer polyester resin micro-dispersion 4 was obtained in the same manner as the above-mentioned aqueous copolymer polyester resin micro-dispersion 1, except that the copolymer ester 4 was used. The average particle diameter of the aqueous copolymer polyester resin micro-dispersion was 0.073 μm.

[Aqueous Copolymer Polyester Resin Micro-dispersion 5]

Aqueous copolymer polyester resin micro-dispersion 5 was obtained in the same manner as the above-mentioned aqueous copolymer polyester resin micro-dispersion 1, except that the copolymer ester 5 was used. The average particle diameter of the aqueous copolymer polyester resin micro-dispersion was 0.043 μm.

[Aqueous Copolymer Polyester Resin Micro-dispersion 6]

Aqueous copolymer polyester resin micro-dispersion 6 was obtained in the same manner as the above-mentioned aqueous copolymer polyester resin micro-dispersion 1, except that the copolymer ester 6 was used. The average particle diameter of the aqueous copolymer polyester resin micro-dispersion was 0.037 μm.

[Preparation of Dispersed Pigment]

(Aqueous Pigment Dispersion 1)

A cyan pigment (Eupolen Blue 69-1501, manufactured by BASF Co., Ltd.) 50 parts by weight, an anionic surfactant (Neogen R, manufactured by Dai-Ichi Kogyo Seiyaku Co., Ltd.) 5 parts by weight, and ion-exchanged water 223 parts by weight were dispersed for 40 minutes by a planetary ball mill (manufactured by Fritsch Co., Ltd.) using zirconia beads with a diameter of ϕ0.5 mm and after that, the dispersion was loaded to a homogenizer (PT 3000, manufactured by Polytron Devices Inc.) and stirred at room temperature for 20 minutes to disperse the pigment and additionally, dispersion was carried out for 20 minutes by an ultrasonic homogenizer (manufactured by Nippon Seiki Co., Ltd.) to obtain an aqueous blue pigment dispersion 1 with an average particle diameter of 0.10 μm.

The average particle diameters of the aqueous pigment dispersion 1 and the aqueous pigment dispersions 2 to 5 described later were measured by MICROTRACK UPA-ST150, manufactured by Nikkiso Co., Ltd.).

(Aqueous Pigment Dispersion 2)

A magenta pigment 1 (Eupolen Red 47-9001, manufactured by BASF Co., Ltd.) 50 parts by weight, an anionic surfactant (Neogen R, manufactured by Dai-Ichi Kogyo Seiyaku Co., Ltd.) 5 parts by weight, and ion-exchanged water 223 parts by weight were dispersed for 40 minutes by a planetary ball mill (manufactured by Fritsch Co., Ltd.) using zirconia beads with a diameter of ϕ 0.5 mm and after that, the dispersion was loaded to a homogenizer (PT 3000, manufactured by Polytron Devices Inc.) and stirred at room temperature for 20 minutes to disperse the pigment and additionally, dispersion was carried out for 20 minutes by an ultrasonic homogenizer to obtain an aqueous red pigment dispersion 2 with an average particle diameter of 0.09 μm.

(Aqueous Pigment Dispersion 3)

A yellow pigment (Eupolen Yellow 09-6101, manufactured by BASF Co., Ltd.) 50 parts by weight, an anionic surfactant (Neogen R, manufactured by Dai-Ichi Kogyo Seiyaku Co., Ltd.) 5 parts by weight, and ion-exchanged water 223 parts by weight were dispersed for 40 minutes by a planetary ball mill (manufactured by Fritsch Co., Ltd.) using zirconia beads with a diameter of ϕ0.5 mm and after that, the dispersion was loaded to a homogenizer (PT 3000, manufactured by Polytron Devices Inc.) and stirred at room temperature for 20 minutes to disperse the pigment and additionally, dispersion was carried out for 20 minutes by an ultrasonic homogenizer to obtain an aqueous yellow pigment dispersion 3 with an average particle diameter of 0.08 μm.

(Aqueous Pigment Dispersion 4)

Carbon black (MOGUL L, manufactured by Cabot Corp.) 50 parts by weight, a nonionic surfactant (Nonipol, manufactured by Sanyo Chemical Industries, Ltd.) 5 parts by weight, and ion-exchanged water 223 parts by weight were dispersed for 40 minutes by a planetary ball mill (manufactured by Fritsch Co., Ltd.) using zirconia beads with a diameter of ϕ0.5 mm and after that, the dispersion was loaded to a homogenizer (PT 3000, manufactured by Polytron Devices Inc.) and stirred at room temperature for 20 minutes to disperse the pigment and obtain an aqueous yellow pigment dispersion 4 with an average particle diameter of 0.13 μm.

(Aqueous Pigment Dispersion 5)

A magenta pigment 2 (Eupolen Red 47-9001, manufactured by BASF Co., Ltd.) 50 parts by weight, a cationic surfactant (Sanisol B 50, manufactured by Kao Corp.) 5 parts by weight, and ion-exchanged water 223 parts by weight were dispersed for 40 minutes by a planetary ball mill (manufactured by Fritsch Co., Ltd.) using zirconia beads with a diameter of ϕ0.5 mm and after that, the dispersion was loaded to a homogenizer (PT 3000, manufactured by Polytron Devices Inc.) and stirred at room temperature for 20 minutes to disperse the pigment and additionally, dispersion was carried out for 20 minutes by an ultrasonic homogenizer to obtain an aqueous red pigment dispersion 5 with an average particle diameter of 0.09 μm.

[Preparation of Aqueous Wax Fine Particle Dispersion]

Paraffin wax (HNP 10, melting point 72° C., manufactured by Nippon Seiro Co., Ltd.) 50 parts by weight, an anionic surfactant (Neogen R, manufactured by Dai-Ichi Kogyo Seiyaku Co., Ltd.) 5 parts by weight, and ion-exchanged water 161 parts by weight were loaded to a stainless beaker equipped with a jacket and dispersed for 30 minutes by a homogenizer (PT 3000, manufactured by Polytron Devices Inc.) while being heated at 95° C. and then transferred to a pressure discharge type homogenizer (manufactured by Nippon Seiki Co., Ltd.) and dispersed at 90° C. for 20 minutes to obtain an aqueous wax fine particle dispersion with an average particle diameter of 0.4 μm. The average particle diameter of the dispersed pigment of the wax fine particles was measured by MICROTRACK UPA-ST150, manufactured by Nikkiso Co., Ltd.).

Example 1

(Mixture Preparation Step)

The above-mentioned aqueous pigment dispersion 2 containing the dispersion type pigment magenta, the above-mentioned aqueous polyester resin micro-dispersion 1 (85% of 90 parts by weight shown in Table 2), and aqueous wax fine particle dispersion at respective ratios shown as solid matter concentrations (part by weight) in Table 2 were mixed to obtain a mixture. In this case, the total solid matter concentration was adjusted to be 10% with water.

(Aggregate Formation Step)

While the obtained mixture being stirred at 1500 rpm by a Max Blend stirring apparatus, an aqueous solution of 1% by weight of magnesium chloride 270 parts by weight as a flocculant was dropwise added and after that, the mixture was stirred for 1 hour. Accordingly, aggregates of a toner were formed in the water medium. Next, the remaining aqueous polyester resin micro-dispersion 1 (the remaining 15% of 90 parts by weight shown in Table 2) was added and an aqueous solution of 1% by weight of magnesium chloride 30 parts by weight was dropwise added and after that, the mixture was stirred for 1 hour. Accordingly, aggregates of a toner were further formed in the water medium.

(Particle Formation Step)

The water medium containing aggregates formed in the aggregate formation step was heated to 75° C. and continuously stirred further for 30 minutes and further at 94° C. for 20 minutes to make the particle diameter and the shape of the aggregates uniform. At that time, to prevent re-flocculation, pH was adjusted to be 10 and sodium straight chain alkylbenzenesulfonate 1 part by weight was added.

(Washing Step)

Next, the supernatant solution of the water medium containing aggregates was removed and the aggregates were washed with water three times (supernatant solution was replaced three times) and successively washed with an aqueous HCl solution adjusted to be at pH 2 and further washed with water three times. The resulting aggregates were filtered and dried by a vacuum drying apparatus to obtain a magenta toner.

The water to be used for washing was water having a conductivity of 0.5 μS/cm and produced from tap water by using an ultrapure water preparation apparatus (Ultra Pure Water System CPW-102, manufactured by ADVANTEC). The pH and conductivity of water were measured by la comme tester (EC-PHCON 10, manufactured by IUCHISEIEIDO), Example 2

A toner was produced in the same manner as Example 1 to obtain a cyan toner of Example 2, except that a mixture was produced from aqueous pigment dispersion 1 containing the dispersion type pigment cyan and the aqueous polyester resin micro-dispersion 2 at respective ratios shown as solid matter concentrations (part by weight) in Table 2.

Example 3

A toner was produced in the same manner as Example 1 to obtain a yellow toner of Example 3, except that a mixture was produced from aqueous pigment dispersion 3 containing the dispersion type pigment yellow and the aqueous polyester resin micro-dispersion 3 at respective ratios shown as solid matter concentrations (part by weight) in Table 2.

Example 4

A toner was produced in the same manner as Example 1 to obtain a black toner of Example 4, except that a mixture was produced from aqueous pigment dispersion 4 containing the dispersion type pigment black and the aqueous polyester resin micro-dispersion 2 at respective ratios shown as solid matter concentrations (part by weight) in Table 2.

Example 5

A mixture was produced from aqueous pigment dispersion 4 containing the dispersion type pigment black and the aqueous polyester resin micro-dispersion 2 at respective ratios shown as solid matter concentrations (part by weight) in Table 2. Herein, a toner same as the black toner of Example 4 was produced by mixing a prescribed part by weight of the polyester resin at once without dividing two times, unlike the case of Example 4 where the polyester resin was flocculated separately two times. In other words, the toner was produced without the step of the flocculation carried out later.

Comparative Example 1

A toner was produced in the same manner as Example 1 to obtain a black toner of Comparative Example 1, except that a mixture was produced from aqueous pigment dispersion 4 containing the dispersion type pigment black and the aqueous polyester resin micro-dispersion 3 at respective ratios shown as solid matter concentrations (part by weight) in Table 2.

Comparative Example 2

A toner was produced in the same manner to obtain a black toner of Comparative Example 2, except that a mixture was produced from aqueous pigment dispersion 4 containing the dispersion type pigment black and the aqueous polyester resin micro-dispersion 2 at respective ratios shown as solid matter concentrations (part by weight) in Table 2 and the flocculant used in Example 1 was changed to Sanisol B 50 (manufactured by Kao Corp.) (alkyldimethylbenzylammonium chloride).

Comparative Example 3

Aggregates were produced in the same manner as Example 1. A magenta toner was produced in the same manner as Example 1, except that the step of washing with the aqueous HCl solution at pH 2 was not carried out but the step thereafter was carried out in the same manner as Example 1.

TABLE 2

| | | Ex. 1 | Ex. 2 | Ex. 3 | Ex. 4 | Ex. 5 | Co. 1 | Co. 2 | Co. 3 |
|---|---|---|---|---|---|---|---|---|---|
| Self-dispersion type binder resin | Polyester 1 | 90 | | 90 | | | | | 90 |
| | Polyester 2 | | 90 | | 87 | 87 | | 87 | |
| | Polyester 3 | | | | | | 87 | | |
| Pigment | Cyan | | 5 | | | | | | |
| | Magenta | 5 | | | | | | | 5 |
| | Yellow | | | 5 | | | | | |
| | Blak | | | | 8 | 8 | 8 | 8 | |
| Wax | | 5 | 5 | 5 | 5 | 5 | 5 | 5 | 5 |

Ex: Example
Co: Comparative Example

[Preparation of Toner]

Respective color toners were obtained by adding (extrapolating) 0.7 part by weight of silica particles subjected to hydrophobic treatment with a silane coupling agent and having an average primary particle diameter of 20 nm to the toners obtained in Examples 1 to 5 and Comparative Examples 1 and 2.

[Preparation of Developer]

The respective toners 70 g of Examples 1 to 5 and Comparative Examples 1 and 2 bearing the extrapolated agent as described and ferrite carrier coated with a thermoplastic resin 1400 g were mixed by a V-shaped mixer to produce developers.

[Evaluation Method]

The respective evaluations of average particle diameter, variable coefficient, average roundness, image density, fogging, pigment dispersibility, and transfer ratio and their collective evaluation were carried out for the toners of Examples 1 to 5 according to the following evaluation methods and the results are shown in Table 3. In Table 3, the symbol ○ shows remarkably excellent in each evaluation and the symbol x shows difficulty for practical application.

(Average Particle Diameter and Variable Coefficient)

The average particle diameter and the variable coefficient were measured by Coulter Multicizer II (manufactured by Coulter Inc.) and evaluated according to the following standard on the basis of the variable coefficient. The number of the measured particles was 50,000 count and the aperture diameter was 100 μm. The unit of the average particle diameter in Table 3 is μm.

○: variable coefficient was 40 or lower
x: variable coefficient was less than 40

(Average Roundness)

The average roundness of the toner particles was measured by using a flow type particle image analyzer (FPIA-2000, manufactured by To a Iyo Denshi Co., Ltd.). The average roundness is defined by the following express relevant to the projected images of the particles detected by the flow type particle image analyzer and has a value in a range of 1 or lower.

Average roundness=(circumference length of circle having the same surface area as that of the projected image)/(circumferential length of the projected image)

(Image Density)

The image density was evaluated according to the following standard based on the optical density of an evaluation image measured by a spectrophotometric calorimeter (X-Rite 938, manufactured by Nippon Lithograph, Inc.). Each evaluation image was produced by carrying out printing using each of the above-mentioned developers and a modified development apparatus of a digital full color copying machine (AR-C 150, manufactured by Sharp Corp.) while controlling the deposition amount of toner particles to be 0.6 mg/cm$^2$ on paper exclusive for full color printing (PP106A4C, manufactured by Sharp Corp.) and using an external fixing apparatus.

○: optical density was 1.2 or higher
x: optical density was less than 1.2

(Fogging)

The fogging was evaluated as follows. In the case of black color toners, the whiteness of paper exclusive for full color printing (PP106A4C, manufactured by Sharp Corp.) with a size of A4 was measured by a whiteness meter (Z-Σ90 COLOR MEASURING SYSTEM, manufactured by Nippon Denshoku Kogyo Co., Ltd.) and the measured value was defined as the first measured value W1. Next, 3 copies of a drawing including a white circle with a diameter of 55 mm was obtained by copying and the whiteness of the white parts of the copies was measured and the measured value was defined as the second measured value W2. The fogging density W (%) was calculated from the following equation and the fogging was evaluated according to the following standard on the basis of the calculated fogging density.

$$W=\{100\times(W1-W2)/W1\}$$

○: fogging density W was 2.0% or lower
x: fogging density W was higher than 2.0%

(Environmental Evaluation)

A prescribed amount of each of the above-mentioned developers was loaded and stored overnight under environmental conditions ((a) 5° C. temperature and 10% humidity; (b) 35° C. temperature and 80% humidity) and rotated at a rotation speed same as the above-mentioned image formation apparatus for 2 minutes and the electric charge quantity of the toner was measured and the evaluation was carried out according to the following standard based on the relative ratio of the electric charge quantity of the toner under (b) the high temperature and high humidity condition to that under (a) the low temperature and low humidity condition.

○: alteration ratio was 60% or lower
x: alteration ratio was higher than 60%

(Transfer Ratio)

The transfer ratio (%) was calculated by measuring the toner particle weight Mp on paper on which a prescribed chart was copied and the toner particle weight Md remaining on a photoconductor and carrying out calculation from the following equation, and the transfer ratio T (%) was evaluated according to the following standard $$T=\{Mp/(Md+Mp)\times 100\}$$

○: the transfer ratio T (%) was 90% or higher
x: the transfer ratio T (%) was lower than 90%

TABLE 3

| | A | B | | C | D | | E | | F | | G | | H |
|---|---|---|---|---|---|---|---|---|---|---|---|---|---|
| Ex. 1 | 6.5 | 28 | ○ | 0.97 | 1.3 | ○ | 0.9 | ○ | 76 | ○ | 94 | ○ | ○ |
| Ex. 2 | 7.3 | 29 | ○ | 0.97 | 1.2 | ○ | 0.8 | ○ | 74 | ○ | 95 | ○ | ○ |
| Ex. 3 | 6.9 | 26 | ○ | 0.97 | 1.3 | ○ | 0.8 | ○ | 77 | ○ | 94 | ○ | ○ |
| Ex. 4 | 7.1 | 29 | ○ | 0.97 | 1.9 | ○ | 0.9 | ○ | 75 | ○ | 93 | ○ | ○ |
| Ex. 5 | 7.3 | 28 | ○ | 0.97 | 1.8 | ○ | 0.9 | ○ | 76 | ○ | 92 | ○ | ○ |
| Co. 1 | 7.1 | 29 | ○ | 0.97 | 1.8 | ○ | 1.1 | ○ | 55 | X | 90 | ○ | X |
| Co. 2 | 25 | 50 | X | 0.88 | — | X | — | X | — | X | — | X | X |
| Co. 3 | 6.5 | 28 | ○ | 0.97 | 1.3 | ○ | 0.9 | ○ | 45 | X | 94 | ○ | X |

Ex: Example
Co: Comparative Example
A: Average particle diameter
B: Variable coefficient
C: Average roundness
D: Image density
E: Fogging
F: Environmental evaluation
G: Transfer ratio
H: Collective evaluation Being made clear from Table 3, it is found that toners excellent in the particle distribution, the image density, the fogging, the environmental evaluation, and the transfer ratio can be produced by the invention (Examples 1 to 5).

Further, based on the comparison of Examples 4 and 5, the toner having a resin layer on the particle surface is slightly stable in the toner chargeability in relation to environments.

Further, based on the comparison of Example 4 and Comparative Example 1, a toner produced by using the carboxylic acid polyester between the carboxylic acid type self-dispersion type polyester and the sulfonic acid group-containing self-dispersion type polyester is found more excellent in the environmental property.

Further, based on the comparison of Example 4 and Comparative Example 2, a toner can be produced more stably by using a polyvalent metal salt as a flocculant.

Further, based on the comparison of Example 1 and Comparative Example 3, it is found that the environmental property becomes unstable since no water washing at pH 6 or lower was carried out in the washing step.

Example 6

(Mixture Preparation Step)

The above-mentioned aqueous pigment dispersion 1 containing the pigment cyan, the above-mentioned aqueous polyester resin micro-dispersion 1 (85% of the weight shown in Table 4) produced by the above-mentioned method and aqueous polyester resin micro-dispersion 4, and the wax fine particle dispersion at respective ratios shown as solid matter concentrations (part by weight) in Table 4 were mixed to obtain a mixture. In this case, the total solid matter concentration was adjusted to be 10% by weight with water.

(Aggregate Formation Step)

While the obtained mixture being stirred at 500 rpm by a Max Blend stirring apparatus, an aqueous solution of 1% by weight of magnesium chloride 270 parts by weight as a flocculant was dropwise added and after that, the mixture was stirred for 1 hour. Accordingly, aggregates of a toner were formed in the water medium. Next, the remaining aqueous polyester resin micro-dispersion 1 (the remaining 15% of the weight shown in Table 4) was added and an aqueous solution of 1% by weight of magnesium chloride 30 parts by weight was dropwise added and after that, the mixture was stirred for 1 hour. Accordingly, aggregates of a toner were further formed in the water medium.

(Particle Formation Step)

The water medium containing aggregates formed in the aggregate formation step was heated to 75° C. and continuously stirred further for 30 minutes and further at 94° C. for 20 minutes to make the particle diameter and the shape of the aggregates uniform. At that time, to prevent re-flocculation, pH was adjusted to be 10 and sodium straight chain alkylbenzenesulfonate 1 part by weight was added.

(Washing Step)

Next, the supernatant solution of the water medium containing aggregates precipitated therein was removed and the aggregates were washed with water three times (supernatant solution was replaced three times) and successively washed with an aqueous HCl solution adjusted to be at pH 2 and further washed with water three times. The resulting aggregates were filtered and dried by a vacuum drying apparatus to obtain a magenta toner.

The water to be used for washing was water having a conductivity of 0.5 μS/cm and produced from tap water by using an ultrapure water preparation apparatus (Ultra Pure Water System CPW-102, manufactured by ADVANTEC). The pH and conductivity of water were measured by a column tester (EC-PHCON 10, manufactured by IUCHISEIEIDO),

Example 7

The above-mentioned aqueous pigment dispersion 2 containing the pigment magenta 1, the aqueous polyester resin micro-dispersion 1, the aqueous polyester resin micro-dispersion 2, and the wax fine particle dispersion at respective ratios shown as solid matter concentrations (part by weight) in Table 4 were mixed to obtain a mixture and after that a toner was produced in the same manner as Example 6 to obtain a magenta toner of Example 7. The aqueous polyester resin micro-dispersion 1 was used in an amount of 85% by weight in the total amount shown in Table 4 in the mixture preparation step and in an amount of 15% by weight in the total amount shown in Table 4 in the next frock formation step.

Example 8

The above-mentioned aqueous pigment dispersion 3 containing the pigment yellow, the aqueous polyester resin micro-dispersion 1, the aqueous polyester resin micro-dispersion 5, and the wax fine particle dispersion at respective ratios shown as solid matter concentrations (part by weight) in Table 4 were mixed to obtain a mixture and after that a toner was produced in the same manner as Example 6 to obtain a yellow toner of Example 8. The aqueous polyester resin micro-dispersion 1 was used in an amount of 85% by weight in the total amount shown in Table 4 in the mixture preparation step and in an amount of 15% by weight in the total amount shown in Table 4 in the next frock formation step.

Example 9

The above-mentioned aqueous pigment dispersion 4 containing the pigment black, the aqueous polyester resin micro-dispersion 1, the aqueous polyester resin micro-dispersion 4, and the wax fine particle dispersion at respective ratios shown as solid matter concentrations (part by weight) in Table 4 were mixed to obtain a mixture and after that a toner was produced in the same manner as Example 6 to obtain a black toner of Example 9. The aqueous polyester resin micro-dispersion 1 was used in an amount of 85% by weight in the total amount shown in Table 4 in the mixture preparation step and in an amount of 15% by weight in the total amount shown in Table 4 in the next frock formation step.

Example 10

The above-mentioned aqueous pigment dispersion 1 containing the pigment cyan, the aqueous polyester resin micro-dispersion 2, the aqueous polyester resin micro-dispersion 5, and the wax fine particle dispersion at respective ratios shown as solid matter concentrations (part by weight) in Table 4 were mixed to obtain a mixture and after that a toner was produced in the same manner as Example 6 to obtain a cyan toner of Example 10. The aqueous polyester resin micro-dispersion 2 was used in an amount of 85% by weight in the total amount shown in Table 4 in the mixture preparation step and in an amount of 15% by weight in the total amount shown in Table 4 in the next frock formation step.

Example 11

The above-mentioned aqueous pigment dispersion 4 containing the pigment black, the aqueous polyester resin micro-dispersion 4, and the wax fine particle dispersion at respective ratios shown as solid matter concentrations (part by weight) in Table 4 were mixed to obtain a mixture. In the same manner as Example 6, the flocculant was added to the mixture to form aggregates and after the aqueous polyester resin micro-dispersion 1 was added and further the flocculant was added to obtain a toner. A black toner of Example 11 was produced in this manner. The aqueous polyester resin micro-dispersion 4 was used all of the amount shown in Table 4 in the mixture preparation step and the aqueous polyester resin micro-dispersion 1 was used all of the amount shown in Table 4 in the next frock formation step. Accordingly, a coating of the aqueous polyester resin micro-dispersion 4 was formed in the inner shell and a coating of the aqueous polyester resin micro-dispersion 1 was formed in the outer shell.

Comparative Example 4

A mixture was obtained by mixing the aqueous pigment dispersion 5 containing the pigment magenta and dispersed by using a cationic surfactant (Sanisol B 50, manufactured by Kao Corp.), the aqueous polyester resin micro-dispersion 1 and the aqueous polyester resin micro-dispersion 4 as self-dispersion type binder resins, and the wax fine particle dispersion at respective ratios shown as solid matter concentrations (part by weight) in Table 4. In this case, when the polyester resins and the pigment dispersion were being mixed and stirred continuously, aggregates were formed to increase the viscosity. Therefore, the aggregate formation thereafter was not carried out.

Comparative Example 5

The aqueous pigment dispersion 1 containing the pigment cyan, the aqueous polyester resin micro-dispersion 1 and the aqueous polyester resin micro-dispersion 6 as self-dispersion type binder resins, and the wax fine particle dispersion at respective ratios shown as solid matter concentrations (part by weight) in Table 4 were mixed to obtain a mixture and after that a toner was produced in the same manner as Example 6 to obtain a cyan toner of Comparative Example 5. The aqueous polyester resin micro-dispersion 1 was used in an amount of 85% by weight in the total amount shown in Table 4 in the mixture preparation step and in an amount of 15% by weight in the total amount shown in Table 4 in the next frock formation step.

Comparative Example 6

Aggregates were produced in the same manner as Example 6. A cyan toner was produced in the same manner as Example 6, except that the step of washing with the aqueous HCl solution at pH 2 was not carried out in the washing step carried out thereafter, but the following step was carried out in the same manner as Example 6.

Comparative Example 7

The aqueous polyester resin micro-dispersion 1 and the aqueous polyester resin micro-dispersion 3 as self-dispersion type binder resins were mixed separately and 88% by weight of the obtained mixture and the aqueous pigment dispersion 1 containing the pigment cyan and the wax fine particle dispersion at respective ratios shown as solid matter concentrations (part by weight) in Table 4 were mixed to form aggregates and thereafter, the remaining 12% by weight of the mixture of the aqueous polyester resin micro-dispersion 1 and the aqueous polyester resin micro-dispersion 3 was added and again the flocculant was added in the same manner as Example 6 to obtain a cyan toner of Comparative Example 7.

Comparative Example 8

A toner was produced using the respective component at respective ratios shown as solid matter concentrations (part by weight) in Table 4 in the same manner as Example 6, except that the flocculant was replaced with Sanisol B 50 manufactured by Kao Corp. (alkyldimethylbenzylammonium chloride) to obtain a magenta toner of Comparative Example 8.

Comparative Example 9

The aqueous pigment dispersion 1 containing the pigment cyan, the aqueous polyester resin micro-dispersion 6, and the wax fine particle dispersion at respective ratios shown as solid matter concentrations (part by weight) in Table 4 were mixed to obtain a mixture. In the same manner as Example 6, the flocculant was added to the mixture to form aggregates and after the aqueous polyester resin micro-dispersion 5 was added and further the flocculant was added to obtain a toner. A cyan toner of Comparative Example 9 was produced in this manner. The aqueous polyester resin micro-dispersion 6 was used all of the amount shown in Table 4 in the mixture preparation step and the polyester 5 was used all of the amount shown in Table 4 in the next frock formation step. Accordingly, a coating of the polyester resin 6 was formed in the inner shell and a coating of the polyester resin 5 was formed in the outer shell.

In Examples 6 to 11 and Comparative Example 4 to 9, in specified one kind aqueous polyester resin micro-dispersion was used in an amount of 85% by weight in the total amount to be used shown in Table 4 in the mixture formation step and in an amount of 15% by weight in the total amount to be used shown in Table 4 in the next aggregate formation step and a mixture of two or three kinds of aqueous polyester resin micro-dispersions may be used separately for the above-mentioned two steps.

TABLE 4

| | | Solid matter (weight %) | | | | | | | | | | | |
|---|---|---|---|---|---|---|---|---|---|---|---|---|---|
| | | Ex. 6 | Ex. 7 | Ex. 8 | Ex. 9 | Ex. 10 | Ex. 11 | Co. 4 | Co. 5 | Co. 6 | Co. 7 | Co. 8 | Co. 9 |
| Self-dispersion type binder resin | Polyester 1 | 15 | 15 | 15 | 15 | | 15 | 15 | 15 | 15 | 15 | 15 | |
| | Polyester 4 | 75 | | | 72 | | 72 | 75 | | 75 | | | |
| | Polyester 2 | | 75 | | | 15 | | | | | | 75 | |
| | Polyester 5 | | | 75 | | 75 | | | | | | | 15 |
| | Polyester 6 | | | | | | | | 75 | | | | 75 |
| | Polyester 3 | | | | | | | | | | 75 | | |
| Pigment | Cyan | 5 | | | | 5 | | | 5 | 5 | 5 | | 5 |
| | Magenta 1 | | 5 | | | | | | | | | 5 | |
| | Yellow | | | 5 | | | | | | | | | |
| | Blak | | | | 8 | | 8 | | | | | | |
| | Magenta 2 | | | | | | | 5 | | | | | |
| Wax | | 5 | 5 | 5 | 5 | 5 | 5 | 5 | 5 | 5 | 5 | 5 | 5 |

Ex: Example
Co: Comparative Example

[Preparation of Toner]

Respective color toners were obtained by adding (extrapolating) 0.7 part by weight of silica particles subjected to hydrophobic treatment with a silane coupling agent and having an average primary particle diameter of 20 nm to the toners obtained in Examples 6 to 11 and Comparative Examples 4 to 9.

[Preparation of Developer]

The respective toners 70 g bearing the extrapolated agent as described and ferrite carrier coated with a thermoplastic resin 1400 g were mixed by a V-shaped mixer to produce developers.

[Evaluation Method]

The respective evaluations of average particle diameter, variable coefficient, average roundness, image density, fogging, and environmental property same as described above as well as fixation property and storability were carried out for the toners of Examples 6 to 11 and Comparative Examples 4 to 9 according to the following evaluation methods and the results are shown in Table 5. In Table 5, the symbol ○ shows remarkably excellent in each evaluation and the symbol x shows difficulty for practical application.

(Fixation Property)

The fixation property was evaluated by fixing each toner on paper on which a specified chart was copied by an external fixing apparatus and measuring the temperature range from the temperature at which the cold off-set occurred and the temperature at which the hot off-set occurred and the evaluation was carried out on the bases of the temperature range of non-off-set.

○: the non-off-set region is 40° C. or higher x: the non-off-set region is lower than 40° C.

(Storability)

The storability was carried out as follows: Each toner 5 g was weighed in a 50 mL sample bottle and tapped and then stored in a high temperature bath at 50° C. for 24 hours. The stored sample was taken out and spontaneously cooled to room temperature and again tapped to observe the agglomeration degree by eye observation. In the case the toner particles were soon loosened to turn back to the initial state, it was evaluated as ○ and in the case of causing agglomeration, it was evaluated as x.

TABLE 5

| | A | B | | C | D | | E | | I | | J | F | | H |
|---|---|---|---|---|---|---|---|---|---|---|---|---|---|---|
| Ex. 6 | 6.5 | 28 | ○ | 0.97 | 1.3 | ○ | 0.9 | ○ | 50 | ○ | ○ | 72 | ○ | ○ |
| Ex. 7 | 7.3 | 29 | ○ | 0.97 | 1.2 | ○ | 0.8 | ○ | 50 | ○ | ○ | 74 | ○ | ○ |
| Ex. 8 | 6.9 | 26 | ○ | 0.97 | 1.3 | ○ | 0.8 | ○ | 50 | ○ | ○ | 71 | ○ | ○ |
| Ex. 9 | 7.1 | 29 | ○ | 0.97 | 1.9 | ○ | 0.9 | ○ | 50 | ○ | ○ | 76 | ○ | ○ |
| Ex. 10 | 6.6 | 28 | ○ | 0.97 | 1.3 | ○ | 0.9 | ○ | 50 | ○ | ○ | 73 | ○ | ○ |
| Ex. 11 | 6.4 | 29 | ○ | 0.97 | 1.9 | ○ | 0.9 | ○ | 55 | ○ | ○ | 75 | ○ | ○ |
| Co. 4 | 25 | 50 | X | 0.88 | — | X | — | X | — | X | — | X | — | X |
| Co. 5 | 7.2 | 28 | ○ | 0.97 | 1.2 | ○ | 0.9 | ○ | 35 | X | X | 75 | ○ | X |
| Co. 6 | 6.5 | 28 | ○ | 0.97 | 1.3 | ○ | 0.9 | ○ | 50 | ○ | ○ | 45 | X | X |
| Co. 7 | 6.5 | 28 | ○ | 0.97 | 1.3 | ○ | 0.9 | ○ | 50 | ○ | ○ | 40 | X | X |
| Co. 8 | 55 | 80 | X | — | — | X | — | X | — | X | — | X | — | X |
| Co. 9 | 7.1 | 28 | ○ | 0.97 | 1.3 | ○ | 0.9 | ○ | 30 | X | ○ | 71 | ○ | X |

Ex: Example
Co: Comparative Example
A: Average particle diameter
B: Variable coefficient
C: Average roundness
D: Image density
E: Fogging
I: Fixation property
J: Storability
H: Collective evaluation Being made clear from Table 5, it is found that toners produced by the toner process of the invention (Examples 6 to 11) were excellent in the toner properties such as the particle distribution, the image density, the fogging, and fixation property and also the fixation property, the storability, and the environmental property. Further, based on the comparison of Examples 9 and 11, the toner of Example 11 having a coating with a resin having a higher molecular weight is slightly improved in the fixation property. On the other hand, with respect to the toner of Comparative Example 4, flocculation occurred in the mixture of the aqueous pigment dispersion and the aqueous polyester resin micro-dispersion before addition of the flocculant since the cationic surfactant was used as the dispersant for the pigment and the toner with a large average particle diameter was produced. Therefore, measurement of the average roundness, the image density, fogging, and fixation property was determined to be unnecessary. Further, in the case of using a polyester resin having a number average molecular weight of 2000 or lower as Comparative Example 5, problems of the fixation property and storability were caused. Since no washing step at pH 6 or lower was carried out in Comparative Example 6, the environmental property becomes unstable. Similarly, since the sulfonic acid group-containing polyester resin was used in Comparative Example 7, the environmental stability becomes unstable. In the case of Comparative Example 8, since no metal salt was used for the flocculant, the particle diameter of the produced particles could not be controlled and large particles were produced and therefore evaluation was carried out. In Example 10 and Comparative Example 9, capsulation was carried out using resins having a molecular weight of 2000 or higher, and in the case of Comparative Example 9 in which the molecular weight difference of the resins was 1000 or lower, it was found that the non-off-set region was narrow and the toner properties were inferior.

The invention claimed is:

1. A process for preparing a toner for electrostatic image development, the process comprising the steps of:

(S1) preparing an aqueous resin particle dispersion containing self-dispersible polyester resin particles as a binder resin but not containing a surfactant, and then mixing an aqueous pigment dispersion and the aqueous resin particle dispersion to prepare a mixture; and (S2) adding a polyvalent metal salt as a flocculant to the mixture while stirring to form aggregates of the pigment bonded to the resin particles, wherein the self-dispersible polyester resin is prepared by reacting a carboxylic acid compound with an alcohol compound inclusive of a polyhydric alcohol, and additionally introducing polyfunctional carboxylic acids into a reaction system of the self-dispersible polyester resin in a terminal period of polymerization of said carboxylic acid compound with said alcohol compound, the carboxylic acid compound being one or more of a polycarboxylic acid having three or more carboxyl groups and its anhydride, said self-dispersible polyester resin having in its main chain a carboxyl group or carboxylic salt as a hydrophilic group.

2. The process according to claim 1, wherein the step (S2) further comprises mixing the aqueous resin particle dispersion containing self-dispersible polyester resin particles with a mixture containing the aggregates while stirring.

3. The process according to claim 1, wherein the toner has an average particle diameter of 10 μm or smaller.

4. The process according to claim 1, wherein the resin particles have an average particle diameter of 0.2 μm or smaller.

5. The process according to claim 1, wherein the polyvalent metal salt is a magnesium salt or aluminum salt.

6. The process according to claim 1, further comprising the step of washing the aggregates with water and drying the aggregates after the step (S2).

7. The process according to claim 6, wherein the washing step includes washing the aggregates one or more time with water having a pH of 6 or lower.

8. The process according to claim 1, wherein the aqueous pigment dispersion contains a dispersant containing at least one of an anionic surfactant and a nonionic surfactant.

9. The process according to claim 1, further comprising the step of heating a mixture containing the aggregates to make the aggregates uniformize in particle diameter and shape after the step (S2).

10. The process according to claim 1, wherein the step (S1) further comprises mixing an aqueous wax fine particle dispersion containing at least one of natural or synthesized wax fine particles to be bonded with the resin particles.

11. The process according to claim 1, wherein the flocculant is mixed with the mixture while stirring by mechanical shear force in the step (S2).

12. A toner for electrostatic image development prepared by the process according to claim 1.

13. The toner according to claim 12, further comprising one or more kinds of inorganic particles adhered to toner particle surfaces, the inorganic particles having an average particle diameter of 1 μm or smaller.

14. An electrostatic image developer containing the toner according to claim 12 and carriers.

15. An image formation method comprising the steps of:

forming an electrostatic latent image on a photoconductor;

forming a toner image by developing the electrostatic latent image on the photoconductor using the electrostatic image developer according to claim 14; and transferring and fixing the toner image onto a recording medium.

16. An image formed by the image formation method according to claim 15.

17. The process according to claim 1 wherein said self-dispersible polyester resin containing two or more kinds of self-dispersible polyester resins having different number average molecular weights wherein the lowest number average molecular weight of the two or more kinds of self-dispersible polyester resins is 2000 or higher, and a difference in number average molecular weight of the resins is 1000 or higher.

* * * * *